US005444359A

United States Patent [19]

Riggio

[11] Patent Number: 5,444,359

[45] Date of Patent: Aug. 22, 1995

[54] LOAD SENSITIVE VARIABLE VOLTAGE MOTOR CONTROLLER

[75] Inventor: Chris A. Riggio, Boulder, Colo.

[73] Assignee: Green Technologies, Inc., Boulder, Colo.

[21] Appl. No.: 905,281

[22] Filed: Jun. 26, 1992

[51] Int. Cl.[6] ..... G05F 1/455

[52] U.S. Cl. ..... 323/237; 323/246

[58] Field of Search ..... 323/237, 239, 242, 243, 323/244, 246, 300; 318/812, 729

[56] References Cited

U.S. PATENT DOCUMENTS

| | | | |
|---|---|---|---|
| 3,441,823 | 4/1969 | Schlabach | 318/221 |
| 3,506,852 | 4/1970 | DeHart | 307/252 |
| 3,633,094 | 1/1972 | Clements | 323/18 |
| 3,821,634 | 6/1974 | Sabolic | 323/24 |
| 3,859,591 | 1/1975 | Saunders | 323/18 |
| 3,961,236 | 6/1976 | Rodek et al. | 323/18 |
| 3,997,825 | 12/1976 | Miyasita et al. | 318/171 |
| 4,011,489 | 3/1977 | Franz et al. | 318/227 |
| 4,048,550 | 9/1977 | Harris | 318/356 |
| 4,052,648 | 10/1977 | Nola | 318/200 |
| 4,078,393 | 3/1978 | Wills | 62/184 |
| 4,158,164 | 6/1979 | Nutz | 323/24 |
| 4,176,307 | 11/1979 | Parker | 318/798 |
| 4,185,575 | 1/1980 | Brown et al. | 112/277 |
| 4,190,793 | 2/1980 | Parker et al. | 318/800 |
| 4,194,145 | 3/1980 | Ritter | 318/799 |
| 4,237,531 | 12/1980 | Cutler et al. | 363/58 |
| 4,242,625 | 12/1980 | Hedges | 318/729 |
| 4,255,695 | 3/1981 | Plunkett et al. | 318/723 |
| 4,266,177 | 5/1981 | Nola | 318/810 |
| 4,271,386 | 6/1981 | Lee | 318/729 |
| 4,287,464 | 9/1981 | Lee et al. | 318/805 |
| 4,298,831 | 11/1981 | Espelage et al. | 318/112 |
| 4,302,717 | 11/1981 | Olla | 323/282 |
| 4,323,835 | 4/1982 | Lee | 318/729 |
| 4,333,046 | 6/1982 | Lee | 323/231 |
| 4,379,258 | 4/1983 | Sugimoto | 318/805 |
| 4,380,730 | 4/1983 | Morton, Jr. | 323/300 |
| 4,404,511 | 9/1983 | Nola | 318/729 |
| 4,417,190 | 11/1983 | Nola | 318/729 |
| 4,426,614 | 1/1984 | Nola | 323/243 |
| 4,433,276 | 2/1984 | Nola | 318/729 |
| 4,439,718 | 3/1984 | Nola | 318/729 |
| 4,459,528 | 7/1984 | Nola | 318/719 |
| 4,469,998 | 9/1984 | Nola | 318/729 |
| 4,567,425 | 1/1986 | Bloomer | 323/237 |
| 4,689,548 | 8/1987 | Mechlenburg | 323/243 |
| 4,766,363 | 8/1988 | Rutter et al. | 323/243 |
| 4,870,340 | 9/1989 | Kral | 323/235 |
| 5,006,973 | 4/1991 | Turner | 363/34 |
| 5,087,870 | 2/1992 | Salesky et al. | 323/276 |
| 5,191,278 | 3/1993 | Carpenter | 323/275 |
| 5,239,255 | 8/1993 | Schanin et al. | 323/237 |

FOREIGN PATENT DOCUMENTS

| | | | |
|---|---|---|---|
| 57-68694 | 4/1982 | Japan . | |
| 58-144597 | 8/1983 | Japan . | |
| 61-142981 | 6/1986 | Japan . | |
| 62-285691 | 12/1987 | Japan . | |
| 2079500A | 1/1980 | United Kingdom | G05F 1/70 |
| 2073921A | 10/1981 | United Kingdom | G05F 1/66 |

OTHER PUBLICATIONS

Frank J. Nola, "Save Power in AC Induction Motors," *Nasa Technical Briefs*, Summer, 1977, pp. 179, 180.

Frank J. Nola, "Fast-Response Power Saver for Induction Motors," *NASA Tech Briefs*, Spring 1979, pp. 6, 7.

Joseph A. Cusack, "VHF Frequency Multiplier," *NASA Tech Briefs*, Spring 1979, p. 7.

(List continued on next page.)

*Primary Examiner*—Thomas M. Dougherty
*Assistant Examiner*—Adolf Berhane
*Attorney, Agent, or Firm*—Coudert Brothers

[57] ABSTRACT

An apparatus and method for controlling the voltage applied to an induction motor is taught. Load sensing is incorporated by monitoring the current through the motor, and combining that signal with a signal derived from the AC line voltage and AC voltage across the motor. This composite signal is averaged, with the resulting averaged signal being utilized to control a device for modulating voltage applied to the motor such as a phase control integrated circuit device.

10 Claims, 5 Drawing Sheets

OTHER PUBLICATIONS

Frank J. Nola, "Improved Power-Factor Controller," *NASA Tech Briefs,* Summer 1980, pp. 133, 134.

Frank J. Nola, "Energy Saving in ac Generators," *NASA Tech Briefs,* Summer 1980, p. 134.

NASA Technology Utilization Office, Technical Support Package, "Power Factor Controller, Brief No. MFS-23280," Apr. 2, 1979, pp. Cover—20.

NASA Technology Utilization Office, Technical Support Package, "Fast-Response Power Saver for Induction Motors," NASA Tech Briefs, Spring 1979, vol. 4, No. 1, MFS-23988, pp. Cover—9.

NASA Technology Utilization Office, Technical Support Package, "Improved Power-Factor Controller," NASA Tech Briefs, Summer 1980, vol. 5, No. 2, MFS-25323, pp. Cover—11.

LOAD SENSITIVE VARIABLE VOLTAGE MOTOR CONTROLLER

FIELD OF THE INVENTION

The present invention relates generally to the field of controlling induction motors, and more particularly to an apparatus for conserving energy in operating induction motors.

BACKGROUND OF THE INVENTION

The use of AC induction motors has become commonplace. Many ordinary appliances and much of the equipment used in residential as well as in industrial and commercial settings utilize such motors. The motors are ordinarily connected to power lines provided by local utility companies, which can vary substantially in voltage between locales and over time. Induction motors typically operate at relatively constant speeds, the speed being independent of the applied AC voltage to the motor over a range of operating voltages.

Unfortunately, induction motors utilize significant power when operating without a load. Specifically, the current drawn by the motor is generally constant, and depends on the voltage applied to the motor. Therefore, it would be desirable to decrease the voltage to the motor when the motor is not loaded, thereby decreasing energy used by the motor. However, most motors are operated by line voltages that are not adjustable by the user. Even where voltage may be adjusted, it is difficult to make the necessary adjustments to quickly respond to changes in load.

The energy consumption of an induction motor is determined from the integral over a predetermined period of the product of the instantaneous AC voltage applied across the motor terminals and the instantaneous AC current through the motor. Typical AC line voltages are sinusoidal. It is known that applying a sinusoidal input to an induction motor will result in both the AC voltage and AC current having the same sine wave shape but offset in time. The time offset between voltage and current is called a phase shift or phase difference and is typically expressed as an angle. For a constant voltage and, hence, relatively constant current, the power consumed by an induction motor may be expressed as $VI\cos\phi$, where V is the average value of the applied AC voltage across the motor, I is the average value of the AC current through the motor and $\phi$ is the phase difference between the voltage and the current. Cos $\phi$ is sometimes referred to as the "power factor". Thus, power consumption is related to the phase difference between the AC voltage applied to the motor and the AC current through the motor. It is well known that the phase difference between the voltage and current in an induction motor and, therefore, power consumption changes with changes in the load applied to the motor. However, when the motor is unloaded the power factor remains large enough to result in substantial wasted energy due to the relatively large current which flows through the motor. While it may, in theory, be possible to maximize the efficiency of an induction motor which is subject to a constant load, many, if not most, applications for such motors involve loads which vary over time.

One method for reducing the energy consumption of an induction motor utilized in the prior art will be referred to as Power Factor Control or PFC. By measuring changes in the phase difference between the voltage and current, changes in power consumption and, thus, in applied load may be detected. This prior art method of PFC involves measuring the phase difference between the voltage and current and using this measured information to interrupt the application of line voltage to the motor for a portion of each AC cycle. By varying the duration of the interruptions of the AC voltage in response to changes in the phase difference between the current and the voltage it is possible to adjust the rms (root mean square) value of the applied voltage. Thus, when the motor is lightly loaded, i.e., $\phi$ is large, the rms voltage is reduced. On the other hand, when the motor is fully loaded, i.e., $\phi$ is small, the rms voltage is increased, i.e., the interruptions of the line voltage applied to the motor are minimized or eliminated.

An example of an apparatus utilizing this PFC approach is disclosed by Nola in U.S. Pat. No. 4,052,648. Nola teaches measuring the phase difference between current and voltage and using the measured information to control the duration of the voltage to an induction motor by means of a triac. A triac is a well known device controlled by a gate which can act to interrupt voltage applied to the motor. Nola measures the voltage applied across the motor by means of a center tap transformer whose primary coil is connected in parallel with the motor. The center tap transformer produces two oppositely phased voltage signals from the terminals of its secondary. These two voltages signals are then passed through a square wave shaper, which is at a uniform high value when AC voltage is positive and is uniformly low when AC voltage is negative. This shaping removes all amplitude information while maintaining polarity information.

Simultaneously, the current is detected by a second transformer, the output of which is also passed through a square wave shaper. The square wave output is then differentiated, creating a series of spikes which indicate moments when the current switches direction and is therefore at zero. These points are referred to as zero point crossings. These spikes are ted into a one-shot circuit, which generates a square wave output. Next, the voltage square wave and the current square wave are multiplied. The resulting rectangular wave consists of pulses with a width related to the phase difference between the current and voltage squarewaves. This signal is then integrated, and the output is monitored. If the load decreases, the phase angle between the current and voltage changes, and the pulse width then changes. Such changes cause the gate control circuit to disengage the triac for a longer portion of each AC cycle, decreasing the rms voltage applied to the motor and energy consumption.

It is believed that the apparatus described has not performed well in practice and has not been commercially successful. The probable explanation for these problems is the complexity of the apparatus. While numerous attempts have been made to diminish this complexity, no prior art Power Factor Control system known to the inventor has overcome these problems.

An example of an attempt to overcome the complexity of the apparatus described in the '648 patent is set forth by Nola in U.S. Pat. No. 4,266,177. In this second patent, Nola teaches a system which also relies on monitoring the phase difference between the voltage and current using different circuitry. Nola's second approach includes generating first and second square wave signals from the AC operating voltage across the motor leads and from the current passing through the motor, respectively. These square wave signals are then summed and integrated to generate a signal which is transmitted to the non-inverting input of an operational amplifier. The edges of these signals are also detected and are used to time a ramp generator. The output of the ramp generator is transmitted to the inverting input of that same operational amplifier. The output of the operational amplifier is the difference between the average value of the summed signal and the value from the ramp generator. The phase difference between current and voltage is measured by the width of the summed signal. Wider pulses yield larger integrated outputs, which are then transmitted to the operational amplifier. Therefore, an increase in the phase difference will result in a larger difference signal from the operational amplifier. This difference signal is used to control a triac which controls AC voltage to the motor.

This apparatus continues to rely upon removing magnitude information from the detected voltage and current signals, and requires complex circuitry to accomplish control of the applied motor voltage. Again, it is believed that the apparatus described in the '177 patent has not enjoyed commercial success.

Most induction motors are designed to operate adequately at predetermined line voltages. Normally, the motor designer must assume that the motor will be operated at the lowest line voltage normally encountered. Such a voltage may be far lower that the normal line voltage available at most locations and at most times. For example, a motor used in a refrigerator must be capable of delivering adequate power under full load during a "brown-out" condition, i.e., when a utility reduces line voltage over its entire grid (or portion thereof) in response to unusually high electrical energy demand. Changes in line voltage affect both motor performance and energy consumption. Wide variations in line voltage are undesirable. Unfortunately, such variations are beyond the control of most motor designers and users. It is noted that ordinary line voltage fluctuations will not result in changes in the phase between the current and the voltage. Therefore, prior art PFC systems will not respond to fluctuations in line voltage.

Therefore, there is a need for a energy savings system for controlling the voltage applied to an induction motor which is simple, which is responsive to changes in line voltage to adjust for such changes, and which is responsive to changes in motor loading to adjust for such changes.

Accordingly, it is an object of the present invention to provide an improved induction motor control system for energy savings.

Another object of the invention is to provide an energy savings system for use with induction motors which are simpler in design than the prior art.

These and other objects of the invention will become apparent to those skilled in the art from the following description and accompanying claims and drawings.

SUMMARY OF THE INVENTION

The present invention comprises an apparatus and method for controlling the voltage applied to an induction motor. The method includes receiving an AC line voltage. An operating AC voltage is generated from the AC line voltage and this operating AC voltage is applied across the motor. A first signal, which is a function of the magnitude of the operating AC voltage, is generated and a second signal, which is representative of the magnitude of the AC current through the motor, is also generated. A composite signal representative of a combination of the first and the second signals is then generated. The composite signal is then averaged to generate an average signal representative of the average value of the composite signal. The operating AC voltage is continually readjusted in response to changes in the average signal.

An apparatus implementing the method of the present invention is also taught. The apparatus includes terminal means for receiving an AC line voltage, means for generating an operating AC voltage from the AC line voltage, connector means for applying the operating AC voltage across the motor, voltage detection means for generating a first signal which is a function of the magnitude of said operating AC voltage, and current sensing means for generating a second signal representative of the magnitude of the AC current through the motor. Signal combining means are provided for generating a composite signal representative of a combination of the first and the second signals, as well as signal averaging means for generating an average signal representative of the average value of the composite signal. Finally, the apparatus includes AC voltage modulation means for adjusting the operating AC voltage in response to the average signal.

In the preferred embodiment of the apparatus of the present invention, the AC voltage modulation means comprises voltage reduction means for switching off the line voltage for a portion of each cycle, the length of the portion being determined by the average value of the composite signal. The voltage modulation means may comprise a phase control integrated circuit device for controlling a triac. The phase control integrated circuit device is responsive to the average signal to generate a control signal operative to control a triac to switch off transmission of the line voltage to the motor for the portion of each cycle.

DETAILED DESCRIPTION OF THE INVENTION

While it is well-known that adjusting the voltage applied to an induction motor depending on the load may be used to save energy, in order to be practical for most applications, voltage adjustment means must be able to quickly respond to changes in the motor load. Available technologies for sensing such changes have not proved practical for widespread application. In this regard, there is a need for a relatively simple, inexpensive, "foolproof" yet reliable energy saving device.

The present invention employs novel means for sensing changes in the loading of an ac induction motor and thereby allowing adjustment of the voltage to the motor to save energy. Previous efforts at sensing variations in the loading of an AC induction motor have focused upon measurement of the phase difference between the motor voltage and motor current. Measuring this phase difference required complex circuitry. The task was further complicated by the fact that the voltage (and current) to the motor were being interrupted during a portion of each cycle. The apparatus of the present invention does not rely on measurement of phase difference. Instead, load sensing is accomplished by monitoring the current through the motor, and measuring changes in a composite signal derived from this current and the voltage applied across the motor. This approach is somewhat contrary to the conventional wisdom in that, for a given voltage, the magnitude of the current through an induction motor is believed not to vary and that only the phase difference changes. Hence the conventional approach teaches that voltage and current magnitude information are unimportant and that only phase timing information is useful in determining the load status of the motor. By contrast, the present invention utilizes this magnitude information which is disregarded in the prior art to determine changes in the load status of the motor.

In another aspect of the present invention, the magnitude of the voltage applied to the motor, called the "operating voltage", is held constant (for a given load) notwithstanding fluctuations in the line voltage.

Figure 1:
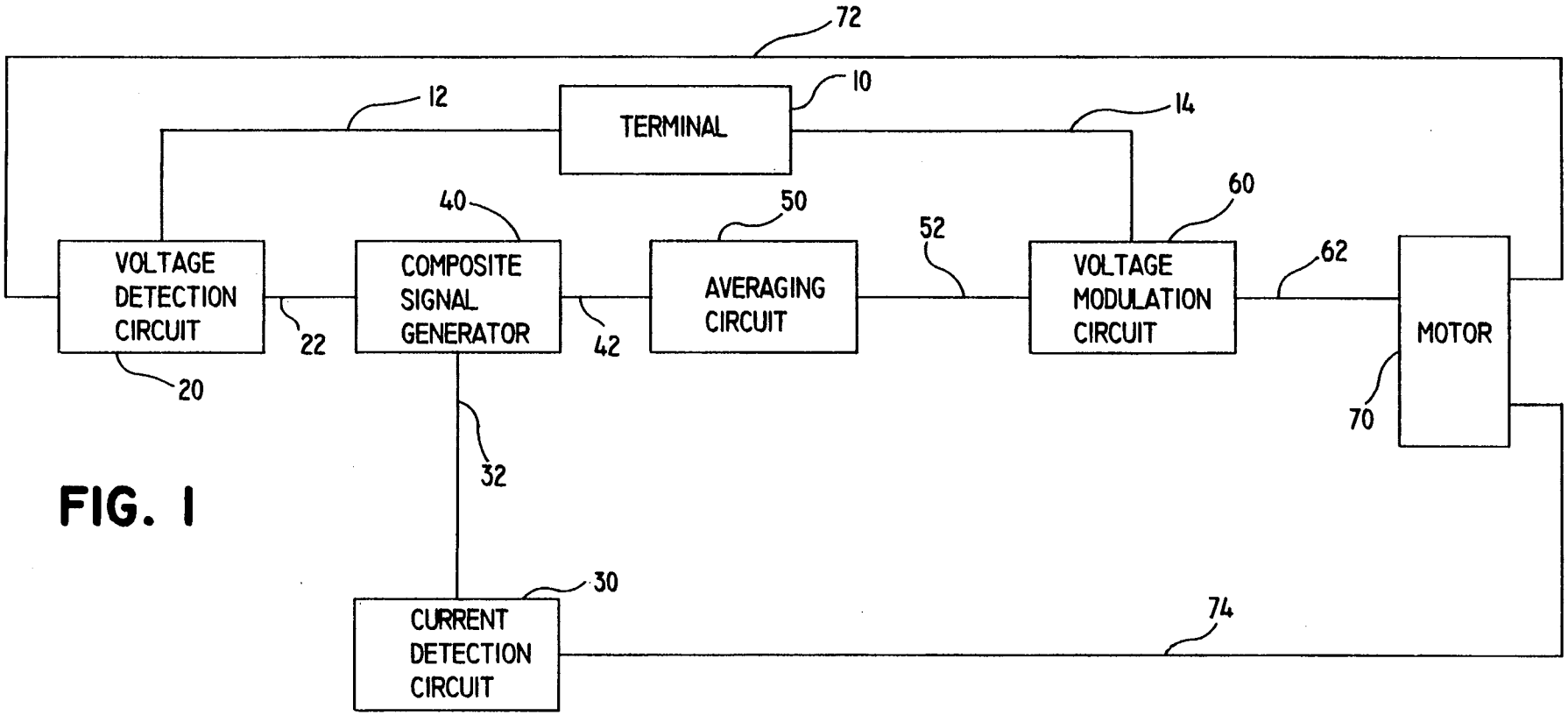
FIG. 1 is a block diagram showing the major functional components comprising the present invention.

A motor controller circuit according to the present invention contains the subcircuits illustrated in block diagram form in FIG. 1. The overall circuit combines two feedback loops. In the first loop the operating AC voltage across a motor 70 is detected by voltage detection circuit 20, which generates a first voltage signal representative of the instantaneous magnitude of the voltage applied to the motor. In the second feedback loop, the current passing through motor 70 is detected by current detection circuit 30, which generates a second voltage signal representative of the instantaneous magnitude of the current through motor 70. The first and second instantaneous voltage signals are then combined in composite signal generator 40 to generate a composite instantaneous signal, which is time averaged in averaging circuit 50 to generate an voltage signal representing the value of the composite signal over at least one complete cycle. This average signal controls a voltage modulation circuit 60, which interrupts application of the AC line voltage to motor 70, thus controlling the magnitude of the operating AC voltage applied to the motor. Voltage feedback to voltage modulation circuit 60 responds both to changes in load and to changes in the operating and line voltages.

More specifically, a terminal 10 is provided for directly receiving an AC line voltage from an AC power supply system (not shown), for example, an ordinary AC outlet. Voltage modulation circuit 60 receives the AC line voltage from terminal 10 via AC voltage connector 14. Voltage modulation circuit 60 modulates the AC line voltage to generate the operating AC voltage applied to the motor. The AC line voltage is modulated so that the power transmitted to motor 70 via modulated AC voltage connector 62 varies in response to a control signal received by voltage modulation circuit 60 from average signal connector 52. The method by which the "average" signal is generated is discussed in detail below. It is important to note that the circuit according to the present invention is utilized in connection with an induction motor 70 which is part of a separate device apart from the motor controller. It is included in the Figures and discussion herein to clarify the relationship between the motor controller circuit and motor 70 to be controlled.

The average signal, which controls voltage modulation circuit 60, is generated by combining two signals. The first signal is generated from the voltage applied across motor 70 by transmitting the operating AC voltage across applied AC voltage connector 72 to voltage detection circuit 20. Voltage detection circuit 20 generates the first signal, which is a function of the magnitude of the operating AC voltage. In the preferred embodiment of the present invention, this representation is a difference signal between the AC line voltage and the operating AC voltage. Hence a difference signal between the AC line voltage received over AC line voltage connector 12 and the operating voltage received over operating AC voltage connector 72 is generated and rectified. Those skilled in the art will recognize that a variety of alternative output signals may be generated which are also functions of the operating AC voltage.

The second signal, representative of the magnitude of the current through the motor, is generated as follows. The current passing through motor 70 is measured from current signal connector 74 by current sensing circuit 30. Current sensing circuit 30 generates a second voltage signal by sensing the current passing through the motor and generating a voltage signal representative of the magnitude of the current passing through the motor. In the preferred embodiment of the present invention, the motor current sensed by current sensing means is rectified by current sensing circuit 30. It will be obvious to those skilled in the art that a variety of output signals may be generated which are also representative of the current passing through motor 70.

The composite signal is generated by composite signal generator 40 from the first signal, which is obtained via first signal connector 22, and from the second signal, which is obtained via second signal connector 32. The resulting composite signal is then transmitted via composite signal connector 42 to averaging circuit 50. Averaging circuit 50 averages the instantaneous value of the composite signal over at least one cycle, to generate a voltage representative of the time average of that AC voltage.

In the preferred embodiment of the present invention, the composite signal is obtained by combining the two voltage signals by means of a resistive voltage divider circuit located within composite signal generator 40. The preferred embodiment also includes an integrator circuit located within averaging circuit 50 to obtain the average signal from the composite signal. The average signal thus generated is a signal representative of the rms value of the sum of the first and second signals, which themselves are related to the magnitudes of the voltage across the motor and the current through the motor, respectively.

Figure 2:
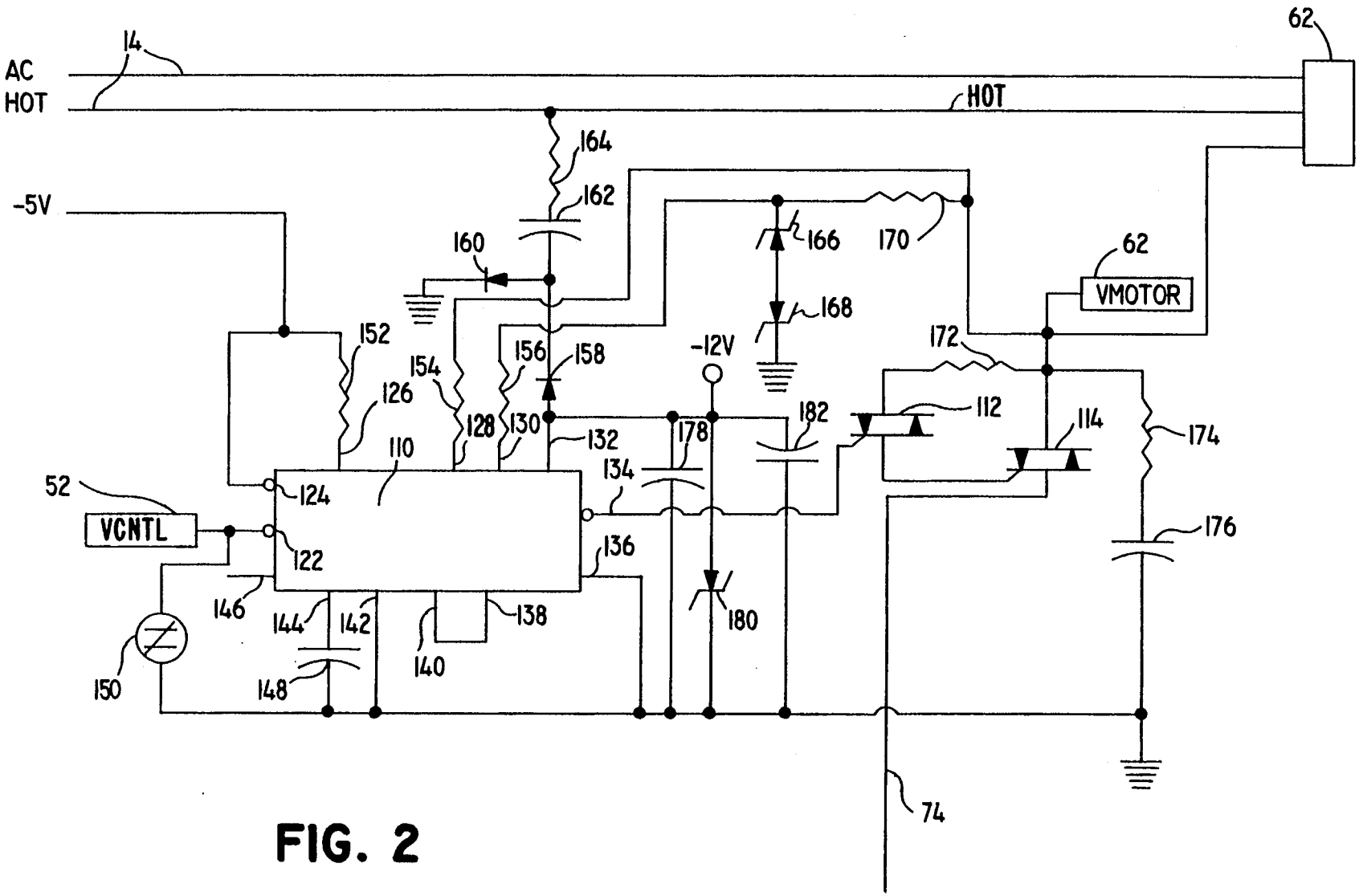
FIG. 2 illustrates an AC voltage modulation means 60 of FIG. 1.

One preferred embodiment of an AC voltage modulation circuit 60 of FIG. 1 according to the present invention is illustrated in FIG. 2. Elements illustrated in FIG. 1 present in FIGS. 2–5 are labelled consistently throughout. In this subcircuit a phase control chip 110 responds to the signal from average signal connector 52 to control pilot triac 112 and thereby main triac 114. Main triac 114 acts to interrupt application of the AC line voltage to motor 70 and thereby generate the operating AC voltage.

The AC line voltage is received at AC voltage modulation circuit 60 via unmodulated AC voltage connector lines 14, including an AC line voltage line ("AC hot") and an AC neutral line.

Modulation of the AC operating voltage of the preferred embodiment of the present invention is accomplished using pilot triac 112 and main triac 114. A triac is a well-known device whereby small current signals applied to its gate can control much larger current flows at much higher voltages. A triac is triggered into conduction by pulses at its gate. In the present circuit a signal applied at the gate of pilot triac 112 from phase control chip 110 permits a current to flow through triac pilot 112, which is applied to the gate of main triac 114. While it might be possible for a single stage triac to be utilized, a two stage triac arrangement allows for control of the relatively large current to a high power motor by a phase control chip which has only a limited capacity to deliver a gate control current. Therefore, this staged triac arrangement permits the output of phase control chip 110 to control the applied AC voltage to motor 70 over modulated AC voltage connector 62.

The voltage applied to the motor is controlled by the control signal pulses received at the gate of pilot triac 112 from phase control chip 110. In one embodiment of the present invention, a TDA 2088 phase controller chip from Plessey Semiconductors is utilized as phase control chip 110. The TDA 2088 chip is designed for use with triacs for use in current feedback applications, and is frequently used for speed control of small universal motors.

Phase control chip 110 requires an applied voltage at voltage input pin 132 of −12 V and a 0 V reference voltage at 0 V reference pin 142. These voltages are used to power the chip and to generate a −5 V reference voltage at −5 V reference pin 124. This voltage is obtained from the AC line voltage by a power supply subcircuit, which operates as follows. Resistor 164 and capacitor 162 are connected in series to the AC line voltage on AC line hot line 14 to provide a filtered voltage to diodes 160 and 158, which permit only the negative half cycle of the AC line voltage to pass. Capacitor 178 is provided to smooth the resulting voltage at voltage input pin 132, and zener diode 180 latches the voltage at that pin to a value of −12 V.

Phase control chip 110 supplies control signal pulses at triac gate output pin 134. Phase control chip 110 has an internal ramp generator whose value is compared to the voltage applied at program input pin 122. When these two values are equal an output pulse is triggered. The ramp generator has two input connections. First, pulse timing resistor input pin 126 is connected to a −5 V reference by pulse timing resistor 152. Secondly, pulse timing capacitor input pin 144 is connected to ground by pulse timing capacitor 148. The values of pulse timing resistor 152 and pulse timing capacitor 148 are chosen to define the slope of the ramp signal.

In addition to the support circuitry for phase control chip 110 described above, AC voltage modulation circuit 60 is provided with a thermal switch 150. Thermal switch 150 is connected between ground and average signal connector 52, which applies the average signal from averaging circuit 50 to program input pin 122 of phase control chip 110. Thermal switch 150 acts to ground out program input pin 122 if the system overhears. This is a safety feature which acts to shut off the motor in the event of circuit overheating.

Also, resistor 174 and capacitor 176 are provided to act as a "snubber" network, which enhances the ability of main triac 114 to operate with inductive loads. In the absence of such a snubber network, false firings of the triac might occur with rapidly varying applied voltages. The snubber network acts to delay the voltage rise to main triac 114 to ensure smooth and correct changes in triac conduction.

Figure 3:
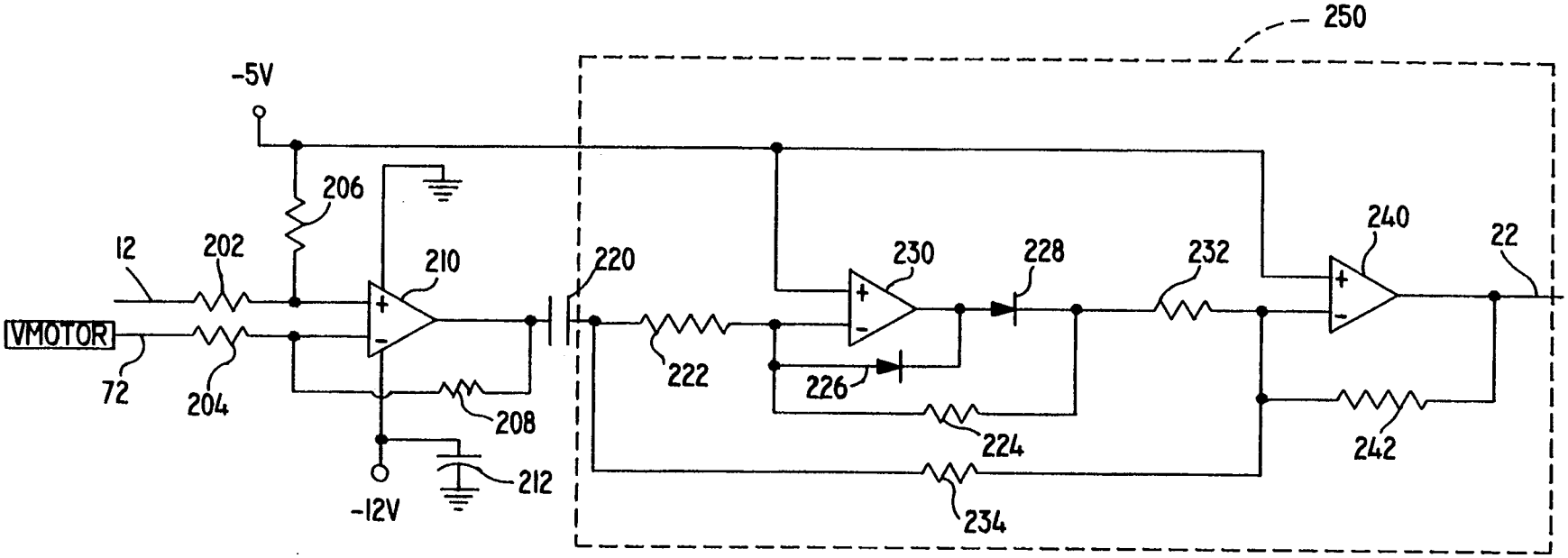
FIG. 3 illustrates an preferred implementation of voltage detection circuit 20 of FIG. 1.

FIG. 3 illustrates a preferred implementation of voltage detection circuit 20 of FIG. 1. In this implementation a difference signal is generated by subtracting operating AC voltage across motor 70 from the AC line voltage. The difference signal is then filtered by phase shift capacitor 220 and rectified by voltage signal rectifier 250 to yield the first signal, which is a representative of the operating AC voltage and of the AC line voltage.

In particular, the AC line voltage is received at AC line voltage connector line 12 and transmitted through resistor 202 to the non-inverting input of operational amplifier 210. Similarly, the operating AC voltage is received at applied AC voltage connector line 72 and is transmitted through resistor 204 to the inverting input of operational amplifier 210. Resistor 206 is connected to −5 V and resistor 208 is connected to the output of operational amplifier 210. Operational amplifier 210 is configured as a differential amplifier. Hence resistor 202 and resistor 204 are chosen to be of identical resistance, and resistor 206 and resistor 208 are also chosen to be of identical resistance.

A phase shift capacitor 220 is disposed between the output of operational amplifier 210 and voltage signal rectifier 250. This capacitor modulates the output signal of operational amplifier 210 to provide a more homogenous rms-like AC value entering the voltage signal rectifier 250.

Voltage signal rectifier 250 includes an inverting operational amplifier 230, which is set to have a unitary gain by utilizing a resistor 224 and a resistor 222 of equal resistance. For the negative portion of the AC signal transmitted from phase shift capacitor 220, the signal is applied at the inverting terminal of inverting operational amplifier 230. The output of inverting operational amplifier is therefore an inverted version of the phase-shifted AC signal from operational amplifier 210. Feedback is provided by resistor 224. This inverted signal passes through diode 228 and resistor 232 and enters the inverting input of operational amplifier 240. For the positive portion of the AC signal transmitted from phase shift capacitor 220, diode 228 blocks transmission of the output signal from inverting operational amplifier 230, and the positive portion is transmitted directly through resistor 234. Therefore, the signal applied to the inverting terminal of operational amplifier 240 is a rectified version of the signal input from phase shift capacitor 220. Operational amplifier 240 amplifies this rectified signal to a gain set by the ratio of the values of resistor 242 to resister 232. The amplified rectified signal is then transmitted to first signal connector 22.

Figure 4:
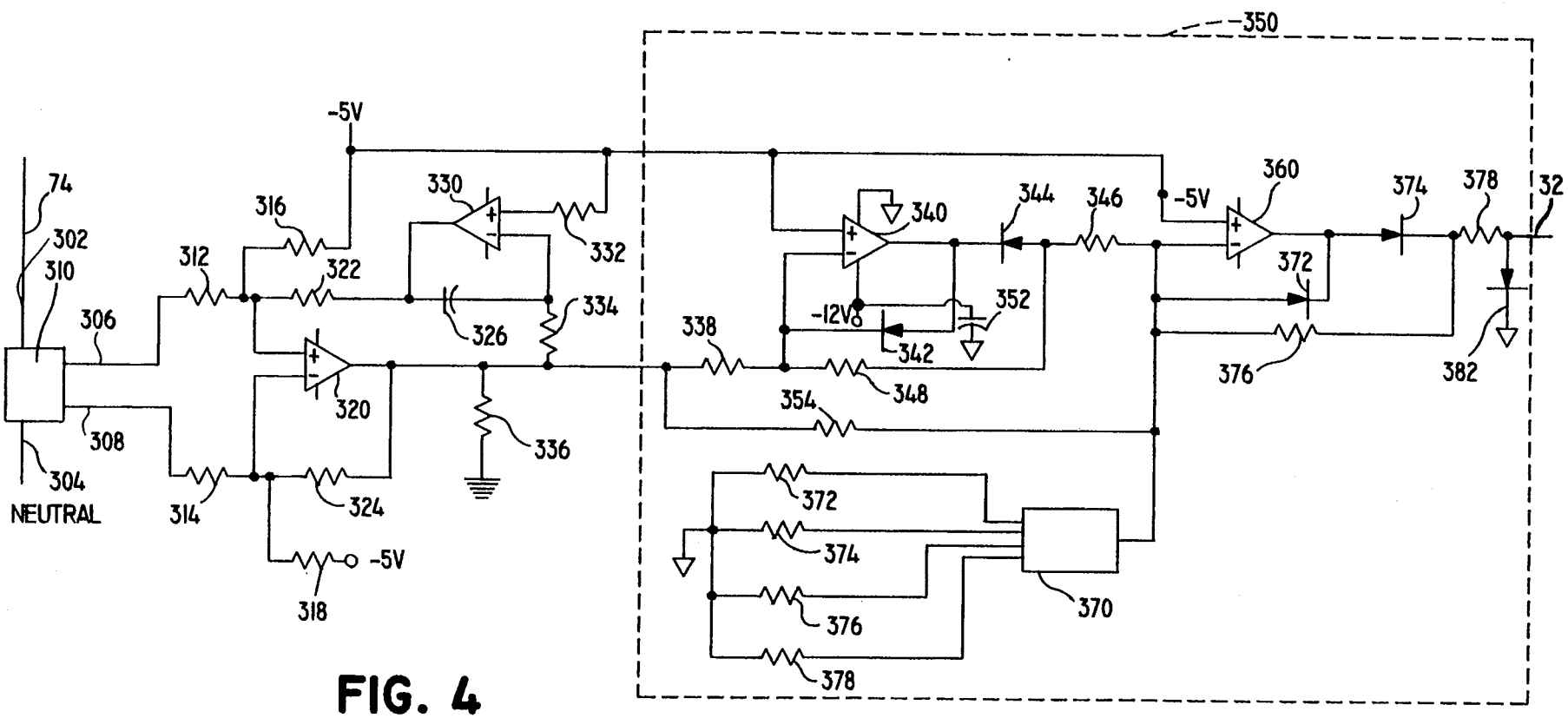
FIG. 4 illustrates a preferred implementation of current sensing circuit 30 of FIG. 1.

FIG. 4 illustrates a preferred implementation of current sensing circuit 30 of FIG. 1. The current flowing through motor 70 may be detected by use of current sensing resistor 310, which produces an instantaneous voltage signal corresponding to the instantaneous magnitude of the current. The resulting voltage signal is then rectified by current signal rectifier 350 to yield the second signal, which is there/ore representative of the current through motor 70.

Current sensing resistor 310 has a first input terminal 302 connected to current signal connector 74 and a second input terminal 304 connected to AC neutral.

Current sensing resistor 310 has a first output terminal 306 connected through resistor 312 to the non-inverting input terminal of differential operational amplifier 320, and a second output terminal 308 connected through resistor 314 to the inverting input of differential operational amplifier 320. In addition, resistor 316 and resistor 318 are provided connected to the non-inverting input and inverting input of differential operational amplifier 320, respectively. Resistors 312,314, 316 and 318 are chosen to be of equal resistance to divide the sensed current equally. Feedback resistor 324 is chosen such that the ratio of the resistance of resistor 324 to that of resistor 314 produces the desired gain.

The output of differential operational amplifier 320 is connected through resistor 334 to the inverting input terminal of integrating operational amplifier 330. Integrating operational amplifier is configured as an integrator by use of capacitor 326 in its feedback loop. The non-inverting input terminal of integrating operational amplifier 330 is connected to −5 V. The output of integrating operational amplifier 330 is connected to the non-inverting input of differential operational amplifier 320. The output of integrating operational amplifier 330 is provided to compensate for common mode DC shifting of the input signal applied across the inputs of differential operational amplifier 320. Such shifting is problematic as the AC component of the input signal is very small, and thus fluctuations in the DC component would be amplified by differential operational amplifier 320. The output of integrating operational amplifier 330 provides compensation for such fluctuations, thereby preventing these fluctuations from being amplified.

The output of differential operational amplifier 320 is also connected resistor 336. Resistor 336 connects the output of differential operational amplifier 320 to ground to curb crossover noise resulting from transitions in signal polarity. Crossover noise is common in certain operational amplifier devices, and is often compensated for by placing a load such as resistor 336 on the output of the operational amplifier.

Current signal rectifier 350 includes an inverting operational amplifier 340, which is set to have a unitary gain by selecting resistor 338 and resistor 348 to be of equal resistance. For the negative portion of the AC signal transmitted from differential amplifier 320, the signal is applied at the inverting terminal of inverting operational amplifier 340. The output of inverting operational amplifier is therefore an inverted, and therefore positive, version of the negative portion of the signal from differential amplifier 320. Feedback is provided by resistor 354. This inverted signal passes through diode 334 and resistor 346 and enters the inverting input of inverting operational amplifier 360.

For the positive portion of the AC signal transmitted from differential amplifier 320, diode 344 blocks transmission of the output signal from inverting operational amplifier 360, and the positive portion is transmitted directly through resistor 354. Therefore, the signal applied to the inverting terminal of inverting amplifier 360 is a rectified version of the signal from differential amplifier 320.

The resulting signal is attenuated by choosing one of resistors 372, 374, 376 and 378 from switch 370. These resistors have different resistances, and switch 370 is provided to allow the user to select the resistance value most appropriate for the motor power characteristics of the particular motor 70 utilized, with larger resistors being appropriate for lower horsepower motors. If the resistance is set too high, then the motor controller will overreact to changes in motor loading. Also, if the resistance is set too low, then the motor controller will not react rapidly to changes in motor loading and hence will not provide optimal energy savings. Alternately, the apparatus of the present invention may be configured with a set resistance to operate with an induction motor within a predetermined range of horsepowers.

As mentioned above, the inverting input of inverting operational amplifier 360 receives, the rectified signal from differential amplifier 320. The non-inverting input of inverting operational amplifier 360 is connected to the −5 V reference voltage. Inverting operational amplifier 360 amplifies the rectified signal to a gain set by the ratio of the values of resistor 376 to resister 346. The amplified rectified signal is then transmitted through diode 374 and resistor 378 to second signal connector 32. Diode 382 is provided to clamp the second signal within a desired operating range. This is necessary to prevent large voltages from flowing through second signal connector 32 and composite signal generator 40 into averaging circuit 50, as large voltages would overcharge the integrator capacitor of the embodiment of averaging circuit 50 discussed below. Such large voltages may occur during the activation of the load controlled by the circuit.

Figure 5:
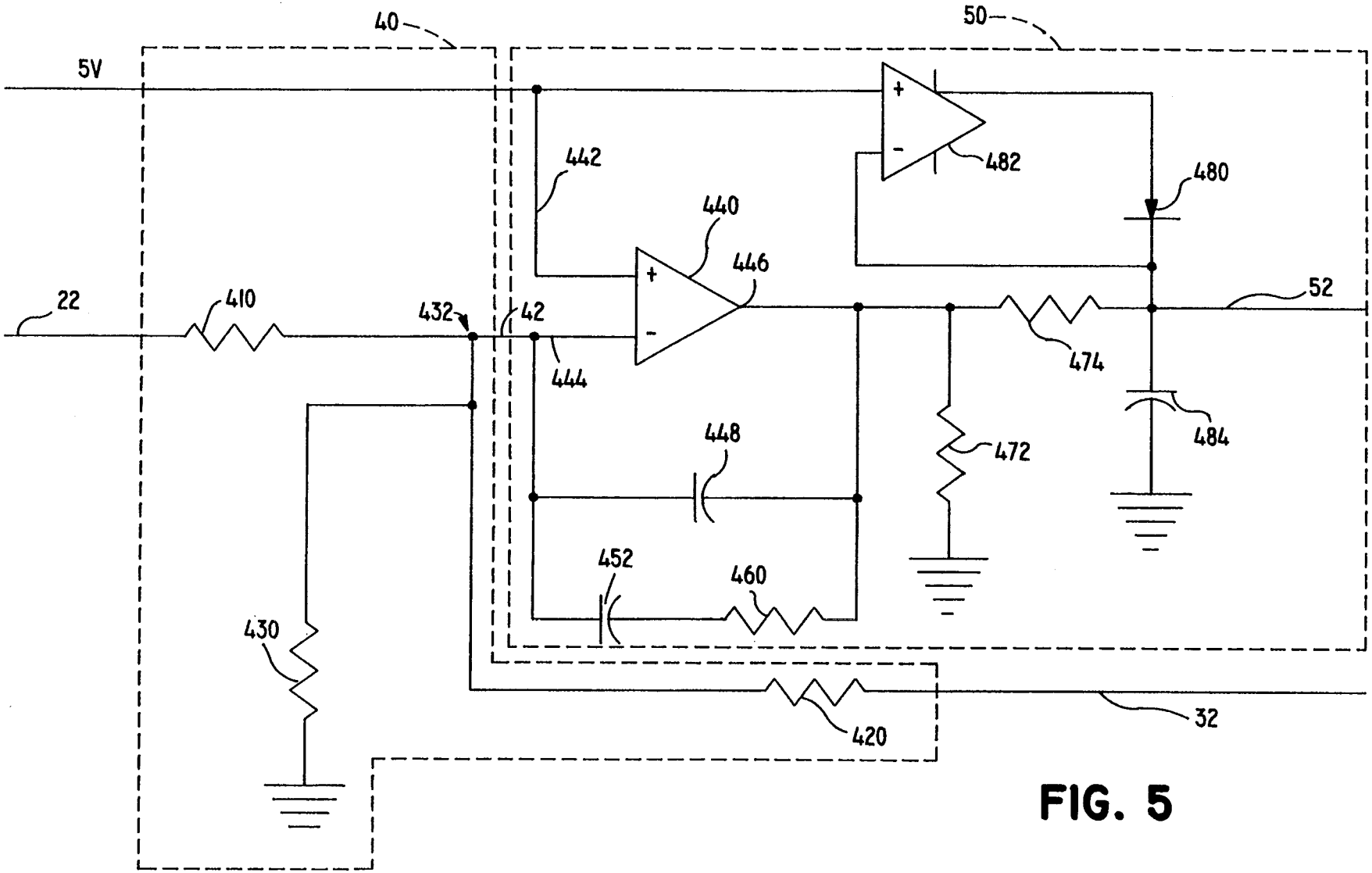
FIG. 5 illustrates a preferred implementation of composite signal generator 40 and of averaging circuit 50 of FIG. 1.

FIG. 5 illustrates a preferred embodiment of a composite signal generator 40 and a preferred embodiment of an averaging circuit 50 of FIG. 1. Composite signal generator 40 comprises a resistive voltage divider network consisting of resistors 410, 420 and 430 and combining node 432. Composite signal generator 40 receives the first signal via first signal connector 22 and the second via second signal connector 32. First signal connector 22 is connected to combining node 432 by resistor 410, and second signal connector 32 is connected to combining node 432 by resistor 420. The value of the resulting composite signal at combining node 432 is determined by the values of resistor 410 and resistor 420 and the values of the first and second signals. By selecting resistor 410 and resistor 420 to have the same resistance, the composite signal at adding node 432 becomes the instantaneous average of the first signal and the second signal, which is half of their sum. The use of other resistance values for resistor 410 and resistor 420 permit changing the relative weights of the first and second signals in generating the composite signal. Set point resistor 430 is provided to affect the average value of the composite signal to match the desired operating range of averaging circuit 50.

The resulting composite signal is then transmitted via composite signal connector 42 to averaging circuit 50. As stated above, averaging circuit 50 provides a time average of the composite signal. The composite signal is an instantaneous AC voltage signal, and the average signal is a voltage representative of the time average of the composite signal over a period corresponding to the period of the AC signal. Hence the average signal varies more slowly than the composite signal, changing only as the load or the rms value of the AC line voltage changes.

The average signal is generated as follows. Composite signal connector 42 is connected to the inverting input terminal 444 of integrating operational amplifier 440. The non-inverting input terminal 442 of integrating operational amplifier 440 is connected to the −5 V reference voltage. The feedback network for integrating operational amplifier 440 includes a capacitor 448 in parallel with the series pair of resistor 460 and capacitor 452 disposed between inverting input terminal 444 and output terminal 446 of integrating operational amplifier 440. The specific values of the capacitors 448 and 452 and resistor 460 are chosen to provide the correct amplification of the composite signal and a time constant appropriate to the anticipated loop dynamics of the load. This time constant determines the responsiveness of the motor controller circuit to changes in the load, and is therefore chosen to allow rapid response to load changes while providing a smooth average of the AC of the composite signal.

Several additional elements are included in averaging circuit 50 to improve its performance and to match the input requirements of phase control chip 110 of FIG. 2. Resistor 472 and the perfect diode combination of diode 480 and operational amplifier 482 ensure that the resulting average signal from output terminal 446 of integrating operational amplifier 440 fall within the desired voltage range. The perfect diode circuit comprising operational amplifier 380 and diode 382 clamps the signal to average signal connector 52 at a minimum of −5 V, and is preferred in driving the high impedance output of integrating operational amplifier 440. Resistor 474 and capacitor 484 act to filter the average signal prior to placement on average signal connector 52.

The operation of the motor controller circuit according to the present invention may be understood in light of the preceding description. In the absence of a load on motor 70, a motor of a given horsepower is expected to draw current with a predetermined relationship to applied voltage. Switch 370 in current signal rectifier is therefore set to chose an appropriate resistance for the specific motor 70 being utilized. The various other resistances, capacitors and reference signal voltages are chosen to ensure that the unloaded system will stabilize at an applied voltage to motor 70 of approximately 60 V.

Upon loading of motor 70, applied voltage to the motor remains at the unloaded value. Thus, the voltage detected by voltage detection circuit 20 will remain unchanged, resulting in an unchanged first signal on first signal connector 22. The current drawn by motor 70 does change, however. As a result, current sensing circuit 30 will change the generated second signal on second signal connecter 32 accordingly. These signals are then combined by composite signal generator 40 and averaged by averaging circuit 50. The average is obtained by integrating the sum of the first and second signals. The value of this average signal increases as the load increases. This average signal is the input to the phase control chip 110 through program input pin 122. The signal on program input pin 122 controls the output of phase control chip 110 on triac gate output pin 134. Increases in load result in earlier firing of triac gate output pin 134 and hence of pilot triac 112. Pilot triac 112 controls main triac 114, which determines the voltage applied across motor 70. As the triacs fire earlier, the voltage applied across motor 70 increases. As the applied voltage across motor 70 is increased, the average value of the composite signal stabilizes and the motor controller circuit stabilizes at a new equilibrium state which provides for efficient operation of motor 70.

By contrast, changes in AC line voltage lead to proportionate changes in the output signal from voltage detection circuit 20. These changes lead to proportionate changes in the composite signal generated by composite signal generator 40 and thus the average signal from averaging circuit 50. The response of voltage modulation circuit 60 to these changes in average signal are clearly identical regardless of whether caused by changes in the voltage difference and thereby the first signal or by changes in current and hence the second signal. Therefore the remaining discussion of the previous paragraph applies to responses to changes in line voltage.

While specific preferred embodiments of the elements of the present invention have been illustrated above, various modifications of the invention in addition to those shown and described herein will become apparent to those skilled in the art from the foregoing description and accompanying drawings. Such modifications are intended to fall within the scope of the appended claims. For example, other available phase control chips may be used instead of the Plessey chip described herein. For example, the Plessey TDA 2086 chip may be used. Likewise, a "custom" integrated circuit chip may be described comprising most of the overall circuitry disclosed herein. In addition, although use of the present invention with inductive motors has been described herein, other applications to different types of loads, such as resistive loads, will become obvious to those skilled in the art. Accordingly, the present invention is to be limited solely by the scope of the following claims.

What is claimed is:

1. A method for controlling the voltage applied to a load, comprising the steps of:

receiving an AC line voltage;

generating an operating AC voltage from the AC line voltage;

applying said operating AC voltage across the load;

generating a first signal which is a function of the magnitude of said operating AC voltage;

generating a second signal representative of the magnitude of the AC current through the load;

generating a composite signal representative of a combination of said first and said second signals;

generating an average signal representative of the average value of said composite signal;

modifying said operating AC voltage in response to changes in said average signal.

2. The method of claim 1 wherein said step of modifying said operating AC voltage comprises reducing the magnitude of said operating AC voltage below the line voltage for a portion of each cycle, the length of said portion being determined by said average signal.

3. The method of claim 2 wherein said step of reducing said load voltage comprises inputting said average signal into a phase control integrated circuit device, said phase control integrated circuit device generating a control signal operative to interrupt transmission of the line voltage to the load for said portion of each cycle.

4. The method of claim 1 wherein the step of generating said average signal comprises inputting said composite signal into a rectifier circuit and rectifying said composite signal, and further comprising inputting the output of said rectifier circuit into an integrator circuit, thereby integrating said composite signal to generate said average signal.

5. A method for controlling the voltage applied to a load, comprising the steps of:

receiving an AC line voltage;

generating an operating AC voltage from the AC line voltage by switching off the AC line voltage to be applied to the load for a portion of each cycle such that the R.M.S. value of the operating AC voltage is below the R.M.S. value of the line voltage;

applying the operating AC voltage across the load;

generating a first signal which is a function of the instantaneous magnitude of said operating AC voltage applied to the load;

generating a second signal representative of the instantaneous magnitude of the AC current through the Load;

generating a composite signal representative of a combination of said first and said second signals;

integrating said composite signal to generate an average signal;

modifying the operating AC voltage by changing the portion of the AC line voltage cycle during which in the applied voltage is switched off in response to said average signal representative of the average value of said composite signal.

6. An apparatus for controlling the voltage applied to a load comprising:

terminal means for receiving an AC line voltage;

means for generating an operating AC voltage from the AC line voltage;

connector means for applying said operating AC voltage across the load;

voltage detection means for generating a first signal which is a function of the magnitude of said operating AC voltage;

current sensing means for generating a second signal representative of the magnitude of the AC current through the load;

signal combining means for generating a composite signal representative of a combination of said first and said second signals;

signal averaging means for generating an average signal representative of the average value of said composite signal;

AC voltage modulation means for adjusting the operating AC voltage in response to said average signal.

7. The apparatus of claim 6 wherein said AC voltage modulation means comprises voltage reduction means for switching off the line voltage for a portion of each cycle, said portion being determined by said average signal.

8. The apparatus of claim 7 wherein said voltage reduction means comprises a phase control integrated circuit device, said phase control integrated circuit device being responsive to said average signal to generate a control signal operative to switch off transmission of the line voltage to the load for said portion of each cycle.

9. The apparatus of claim 8 wherein said signal averaging means comprises a rectifying circuit connected to said signal combining means and an integrator circuit connected to said rectifying circuit and to said AC voltage modulation means.

10. An apparatus for controlling the voltage applied to a load comprising:

means for receiving an AC line voltage;

means for generating an operating AC voltage from the AC line voltage by reducing the AC line voltage to be applied to the load for a portion of each cycle;

means for applying said operating AC voltage across the load;

voltage detection means for generating a first signal which is a function of the magnitude of said operating AC voltage;

current sensing means for generating a second signal representative of the magnitude of the AC current through the load;

signal combining means for generating a composite signal representative of a combination of said first and said second signals;

signal averaging means for generating an average signal representative of the average value of said composite signal;

AC voltage modulation means for modifying said generation of said operating AC voltage by changing said portion of the cycle during which in the applied voltage is reduced in response to said average signal.

* * * * *